US011266214B2

(12) United States Patent
Batey

(10) Patent No.: US 11,266,214 B2
(45) Date of Patent: Mar. 8, 2022

(54) CLEANING APPARATUS FOR MOBILE ELECTRONIC DEVICES

(71) Applicant: SANSEVA LTD, Douglas (GB)

(72) Inventor: Derek Batey, Douglas (GB)

( * ) Notice: Subject to any disclaimer, the term of this patent is extended or adjusted under 35 U.S.C. 154(b) by 120 days.

(21) Appl. No.: 14/403,016

(22) PCT Filed: May 23, 2013

(86) PCT No.: PCT/GB2013/051354

§ 371 (c)(1),
(2) Date: Nov. 21, 2014

(87) PCT Pub. No.: WO2013/175219

PCT Pub. Date: Nov. 28, 2013

(65) Prior Publication Data

US 2015/0143648 A1 May 28, 2015

(30) Foreign Application Priority Data

| | | |
|---|---|---|
| May 23, 2012 | (GB) | 1209284 |
| Aug. 28, 2012 | (GB) | 1215263 |
| Oct. 16, 2012 | (GB) | 1218561 |

(51) Int. Cl.
*A45C 11/00* (2006.01)
*A47L 13/16* (2006.01)
(Continued)

(52) U.S. Cl.
CPC ..... *A45C 11/00* (2013.01); *A47L 13/16* (2013.01); *A47L 13/17* (2013.01); *A47L 25/00* (2013.01); *A45C 2011/002* (2013.01)

(58) Field of Classification Search
CPC ... G06F 1/1628; H05K 13/0084; A45C 11/00; A45C 2011/002; A47L 13/17; A47L 25/00; A47L 13/16
(Continued)

(56) References Cited

U.S. PATENT DOCUMENTS 3,921,797 A * 11/1975 Platt ..... A45C 11/04 206/233
5,626,224 A * 5/1997 Clark ..... A45C 11/04 206/5
(Continued)

FOREIGN PATENT DOCUMENTS

CN 201491877 U 6/2010
EP 2103231 A1 9/2009
(Continued)

OTHER PUBLICATIONS

International Search Report dated Sep. 20, 2013 in corresponding International Application No. PCT/GB2013/051354.
(Continued)

*Primary Examiner* — J. Gregory Pickett
*Assistant Examiner* — Jenine Pagan
(74) *Attorney, Agent, or Firm* — Butzel Long

(57) ABSTRACT

A housing for a mobile device (4) comprises a pouch (1) or case including cleaning material arranged to clean the surface of the mobile device (4) as it is slid into or out of the housing. Shock-absorbing material (5) may be provided between the cleaning material (3) and the pouch (1) or case. The pouch may be reversible for use as a cleaning pad or mitt, and may include a pocket (6) for holding the mobile device when the pouch is reversed.

19 Claims, 6 Drawing Sheets

(51) Int. Cl.
*A47L 13/17* (2006.01)
*A47L 25/00* (2006.01)

(58) Field of Classification Search
USPC ..... 206/320, 576, 701; 15/104.93, 246, 15/210.1, 104.94
See application file for complete search history.

(56) References Cited

U.S. PATENT DOCUMENTS

| | | | | |
|---|---|---|---|---|
| 6,923,313 | B1 | 8/2005 | Orogun-Thomas | |
| 8,073,131 | B2 * | 12/2011 | Bodkin | A45C 3/001 132/309 |
| 8,225,928 | B2 * | 7/2012 | Perrier | A45C 11/00 206/305 |
| 8,605,892 | B1 * | 12/2013 | Owens | H04M 1/17 379/439 |
| RE45,179 | E * | 10/2014 | Bodkin | A45F 5/02 190/119 |
| 2004/0166910 | A1 | 8/2004 | Ha et al. | |
| 2005/0161352 | A1 | 7/2005 | Huddleston | |
| 2008/0257921 | A1 * | 10/2008 | Chauhan | A45C 11/00 224/191 |
| 2009/0286581 | A1 * | 11/2009 | Hsiao | A45C 11/00 455/575.8 |
| 2010/0012536 | A1 * | 1/2010 | Winsche | A45C 11/38 206/316.2 |
| 2011/0290841 | A1 | 12/2011 | Philippe | |
| 2012/0008880 | A1 | 1/2012 | Toth | |
| 2012/0114270 | A1 | 5/2012 | Roberts | |
| 2012/0138490 | A1 * | 6/2012 | Hollander | A45C 11/00 206/205 |
| 2012/0261289 | A1 * | 10/2012 | Wyner | A45C 11/00 206/320 |
| 2012/0309475 | A1 * | 12/2012 | Johnson | H04M 1/04 455/575.8 |
| 2013/0118935 | A1 * | 5/2013 | Zar | B65D 85/00 206/320 |
| 2013/0326829 | A1 * | 12/2013 | Wilson | B08B 1/006 15/104.8 |

FOREIGN PATENT DOCUMENTS

| | | | |
|---|---|---|---|
| EP | 2389830 | A1 | 11/2011 |
| GB | 343210 | A | 2/1931 |
| GB | 2458474 | A | 9/2009 |
| JP | 2001275730 | A | 10/2001 |
| JP | 2003079418 | A | 3/2003 |
| JP | 2008018113 | A | 1/2008 |
| KR | 201205272 | Y1 | 7/2012 |
| WO | 2008037438 | A1 | 4/2008 |
| WO | 2011053264 | A1 | 5/2011 |
| WO | 2013142523 | A1 | 9/2013 |

OTHER PUBLICATIONS

Office Action dated Jul. 15, 2016 as received in EP Application No. 13731848.

Report of Consultation dated Feb. 23, 2018 as received in EP Application No. 13731848.1.

* cited by examiner

CLEANING APPARATUS FOR MOBILE ELECTRONIC DEVICES

FIELD OF THE INVENTION

This invention relates to cleaning apparatus for mobile electronic devices, particularly for such devices having touch-sensitive screens.

BACKGROUND OF THE INVENTION

Mobile electronic devices with touch-sensitive screens ('touchscreens') for providing user input have proved highly popular with consumers; examples include tablet computing devices or smartphones such as the Apple® iPad®, iPod® and iPhone®, the Blackberry® Torch®, and the Samsung® Galaxy Ace®. However, use of the touchscreens tends to leave marks on the screen, such as finger marks, which then need to be cleaned to preserve the appearance of the device and the visibility of the screen.

One solution is for the user to carry a suitable cleaning cloth, made for example of microfiber, and manually clean the screen as it gets dirty. However, this requires a specific cleaning action by the user, and it may be inconvenient for the user to carry a cleaning cloth. Another solution is to carry the mobile device in a pouch made of cleaning material, which serves to protect the device to some extent, and also can be used for cleaning. However, this again requires a specific cleaning action by the user.

GB-A-2458474 discloses a stretchable knitted pouch with an inner lining of stretchable microfibre for cleaning a mobile device as it is inserted or removed. US-A-20080257921 discloses a cleaner pouch with a soft fabric inner layer. US-A-20040166910 discloses a case for a cellular phone, with corrugated internal protrusions for absorbing external impact.

SUMMARY OF THE INVENTION

According to one aspect of the present invention, there is provided a housing, for a mobile electronic device having a screen, the device being slidably removable from and insertable into the housing, and the housing having a localised portion of cleaning material arranged to clean the screen of the device as the device is removed from, or inserted into the housing.

Advantageously, the housing provides the dual functionality of protecting the device and cleaning the screen of the device, without requiring the user to perform any specific cleaning action. Instead, the localised portion of cleaning material automatically cleans the screen as a side effect of the device being removed from or inserted into the housing.

The localised portion of cleaning material may project inwardly of the inner surface of the housing, so as to apply pressure to the screen of the device as it slides past the cleaning portion and thereby enhance the cleaning effect. This feature is preferable for devices in which the screen is recessed slightly from its surround in the device, but is also applicable to devices where the screen is flush with the surround, or where the screen extends to the edges of the device.

A shock-absorbing material may be provided between the cleaning material and the pouch, to protect the device from shock without contacting the device.

In one embodiment, the housing comprises a flexible pouch. Preferably, the major inner faces of the pouch are biased together so that pressure is applied to the surface of device, and particularly to the screen of the device, during insertion or removal.

The flexible pouch may be reversible, and may include an internal pocket that can hold the device when the pouch is reversed, so that the reversed pouch can be used to clean another device without causing damage to the device.

In another embodiment, the housing comprises a substantially rigid case for the device, the housing including a window through which the screen is visible when the device is located within the housing. The localised portion of cleaning material is preferably located on the inner surface of a surround of the window, towards an insertion aperture for the device.

It will be appreciated that the form of the housing in embodiments of the invention will depend on the form of the device for which the housing is intended, and that aspects of the invention must therefore be described in functional terms with reference to the device. However, in practical situations, the skilled person will have little difficulty in determining the scope of the present invention.

BRIEF DESCRIPTION OF THE DRAWINGS

There now follows, by way of example only, a detailed description of embodiments of the present invention, with reference to the figures identified below.

DETAILED DESCRIPTION OF EMBODIMENTS OF THE INVENTION

Figure 1A:
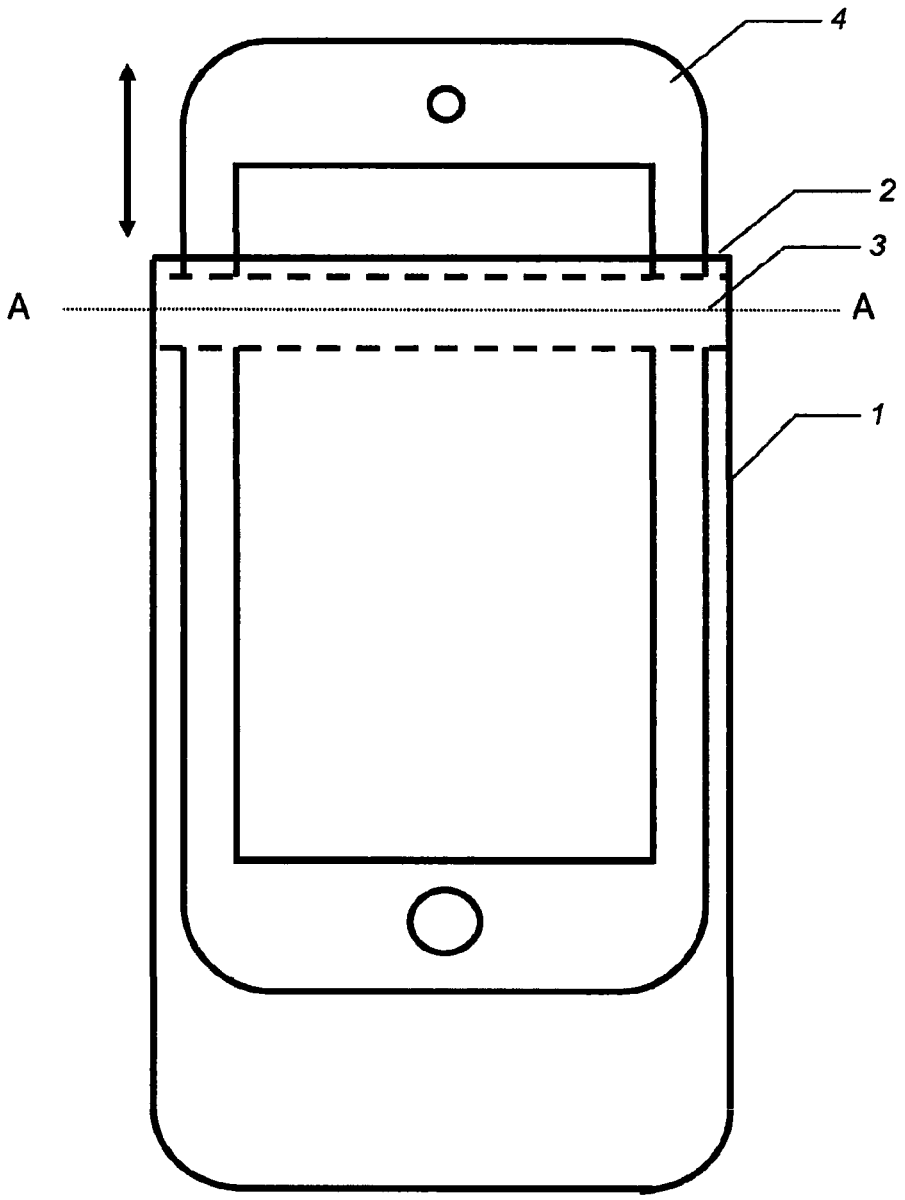
FIG. 1*a* is a schematic plan diagram of a first embodiment of the invention.

In the following description, the same reference numerals are used to indicate similar, though not necessarily identical features between the different embodiments. The figures are intended to be schematic and not to scale, and relative dimensions should not be derived from them.

First Embodiment

FIGS. 1*a* to 2*b* show a first embodiment of the invention, comprising a pouch, sleeve or similar structure 1 for housing a mobile electronic device 4. The pouch 1 includes an opening 2 at at least one end thereof, for sliding insertion and removal of the device 4 into and out of the pouch 1, as shown by the arrows in the Figures. Optionally, and not shown in the Figures, the opening 2 may be closable by a moveable or removable portion, such as a lid or cover.

At least a portion of the inner surface of the pouch 1 comprises cleaning material 3, such a microfibre material, suede, cotton, linen, natural or artificial sponge, or the like. The cleaning material 3 is selected for its ability to clean finger marks, or other marks such as water marks, from the surface of the device 4, without damaging said surface.

The cleaning material 3 may be treated or impregnated with a cleaning and/or disinfecting liquid or additive. Preferably, the cleaning material 3 is treated with a permanent antimicrobial treatment that does not require replenishment during the effective lifetime of the pouch 1. The antimicrobial treatment may be bonded to the cleaning material 3 during manufacture. In one example, the antimicrobial treatment comprises a silane base bonded to the surface of the cleaning material 3, a positively charged component that attracts a negatively charged cell membrane, and/or a long molecular chain that pierces the cell membrane. In another example, the antimicrobial treatment comprises an ionic silver surface treatment.

The cleaning material 3 may be bonded or otherwise fastened to the inner surface of the pouch 1, for example by means of an adhesive or by stitching, so as to inhibit relative movement between the cleaning material 3 and the pouch 1 and thereby enhance the cleaning action.

The pouch 1 itself may be made of protective material, such as plastic, leather, fabric or suede, so as to protect the surface of the device 4 from scratches or other damage. The pouch 1 is preferably dimensioned to provide a tight or snug fit for the device 4, such that the inner surface of the pouch 1 is pressed against the surface of the device 4 as it is inserted into or removed from the pouch 1, thus wiping the cleaning material along, and thereby cleaning, the surface of the device 4. The pouch 1 and/or the cleaning material 3 may be resilient, to ensure a suitable pressure of the cleaning material 3 against the surface of the device 4. For example, the major faces of the pouch 1 may be made of congruent rectangular sheets of resilient material fixed together at three of their edges.

Figure 1B:
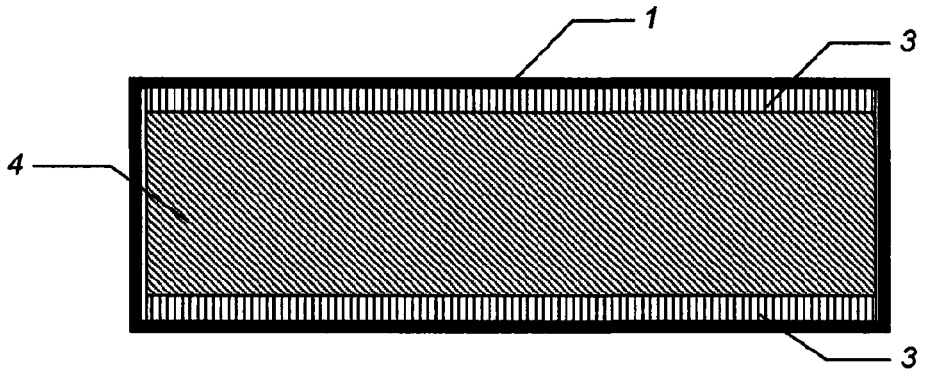
FIG. 1*b* is a schematic cross-section through the line A-A of FIG. 1*a;*

The cleaning material 3 may be provided on both inner major faces of the pouch 1, as shown in FIG. 1*b*, or on only one face, preferably the one which is intended to contact a screen of the mobile device 4. The cleaning material 3 may be provided only on a portion of the inner surface adjacent the opening 2, as shown schematically in FIG. 1*a*, so that it cleans the surface of the device 4 as it passes the portion. The cleaning material 3 may project inwardly from the inner surface of the pouch 1, so as to apply pressure to the surface of the device 4 and thereby enhance the cleaning effect. Providing the cleaning material 3 only on a portion of the inner surface enhances the pressure, as the force between the pouch 1 and the device 4 is concentrated on a smaller area. Alternatively, the cleaning material 3 may be provided over substantially the whole area of one or both inner major faces, to maximize the cleaning area.

Figure 1C:
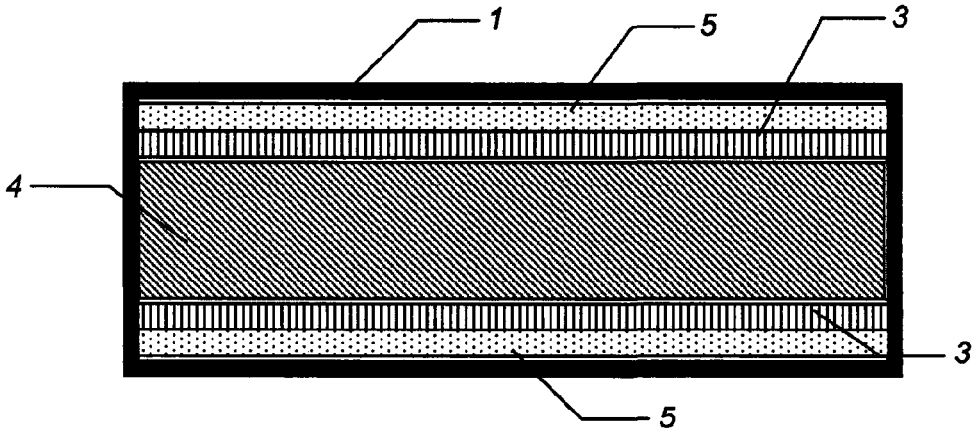
FIG. 1*c* is a schematic cross-section showing an alternative construction to that of FIG. 1*b;*
Figure 2A:
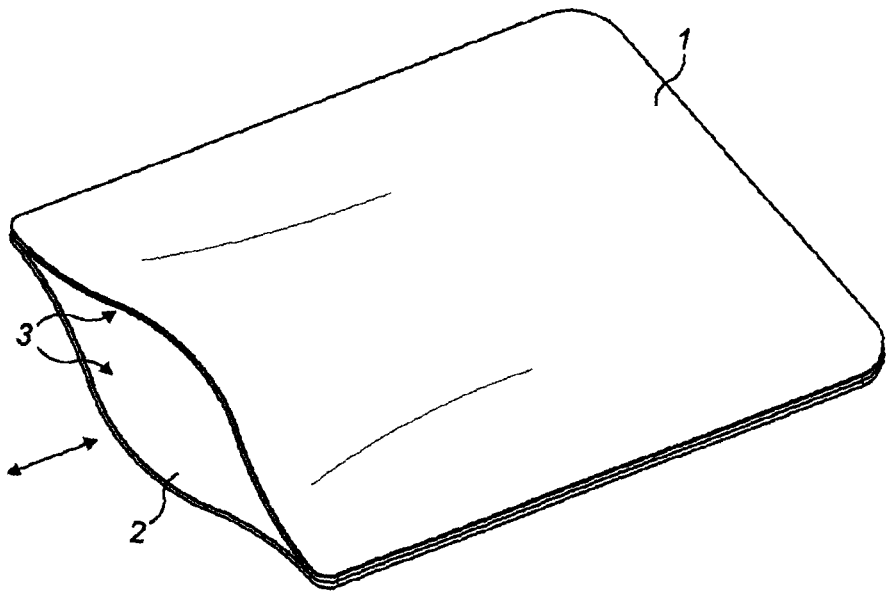
FIGS. 2*a* and 2*b* are perspective front and rear views of a pouch in the first embodiment.
Figure 2B:
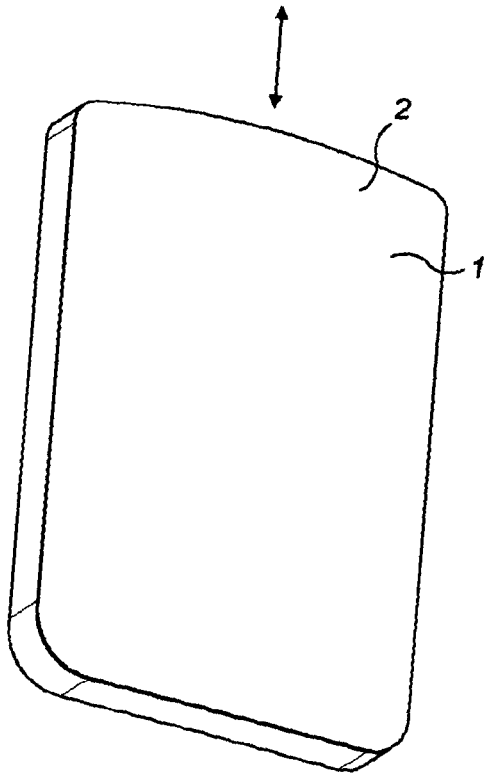

Optionally as shown in FIG. 1*c*, a shock-absorbent material 5 such as EPE polyethylene foam may be provided between the inner surface of the pouch 1 and the cleaning material 3. In this way, the pouch 1 may protect the device 4 from shock as well as providing a cleaning function. Preferably, the shock-absorbent material 5 may be resilient so as to press the cleaning material 3 against the device 4. The construction of the shock absorbent layer 5 between the inner surface of the pouch 1 and the cleaning material 3 is particularly advantageous, as the cleaning material 3 protects the surface of the device 4 from coming into contact with the shock-absorbent material 5, which may then be selected for optimum shock absorbing performance without regard to compatibility with the surface of the device 4.

The cleaning material 3 and/or the shock-absorbent material 5 may have anti-static properties, for example by impregnation with anti-static solvent.

Figure 3:
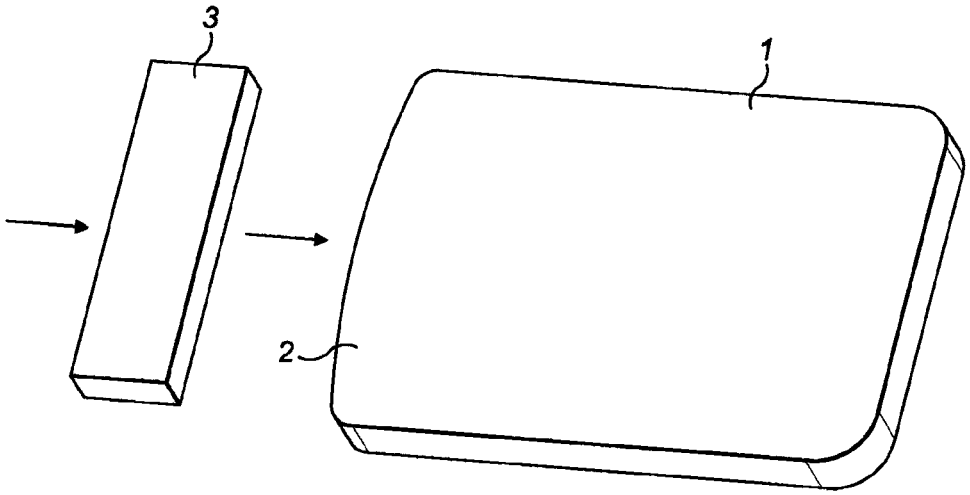
FIG. 3 is a perspective view of a variant of the first embodiment, with a removable portion of cleaning material.

As shown in FIG. 3, the cleaning material 3 may alternatively be provided separately from the pouch 1, for example as an insert or liner that can be fitted to the pouch 1. The insert may be permanently fixed within the pouch 1, or may be removable for cleaning or replacement, for example by means of a removable fixing such as Velcro®, poppers, clips or the like. The insert may include a resilient structure, such as one or more plastic or metal strips, so as to bias the cleaning material 3 against the surface of the device 4. The cleaning material 3, when separated from the pouch 1, may be used to clean the surface of the device 4 or of another device, such as a tablet computer which is not able to fit within the pouch 1.

Figure 4:
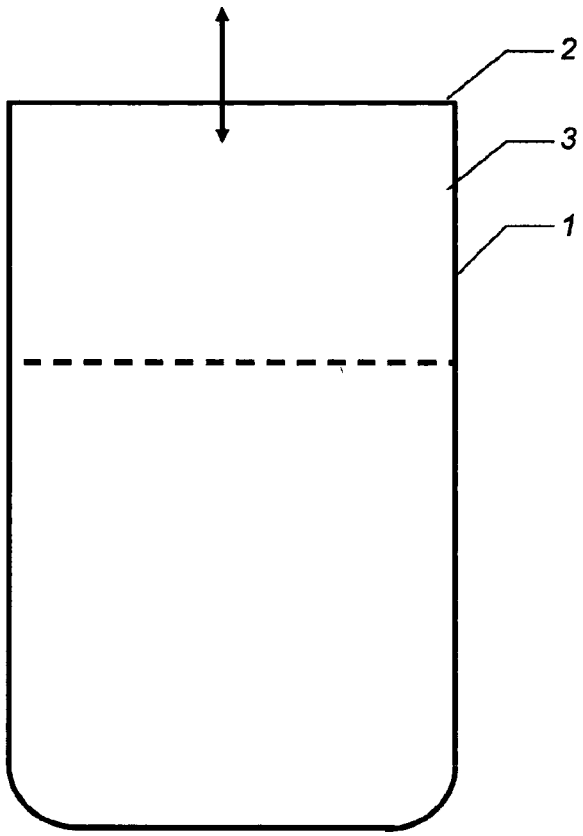
FIG. 4 is a schematic plan view of another variant of the first embodiment, with a removable cleaning portion.

In another variant, shown in FIG. 4, the cleaning material 3 may be provided on one or both sides of a substrate. The substrate may be shaped to fit within the pouch 1 through the opening 2. The substrate may have a width that is approximately equal to the width of the opening 2 and/or the width of the pouch 1. The substrate may be removably held in position by abutment of its sides against the sides of the pouch 1; thus, no specific removable fixing is required on the substrate itself.

The substrate may be resilient or flexible; this facilitates cleaning of another device with the cleaning material, since the resilience may be used to apply an even pressure of the other device when cleaning. The substrate may be of plastics material.

The substrate may be approximately rectangular and may be credit-card sized (e.g. conforming to standard ISO/IEC 7810 ID-1, 2 or 3), for easy storage in a wallet or the like when separated from the pouch 1.

Second Embodiment

In a second embodiment, the pouch 1 is reversible (i.e. able to be turned inside out) so that the cleaning material 3 is on the outside, and may then be used to clean the device 4 or another device, as a cleaning pad or mitt.

Figure 5A:
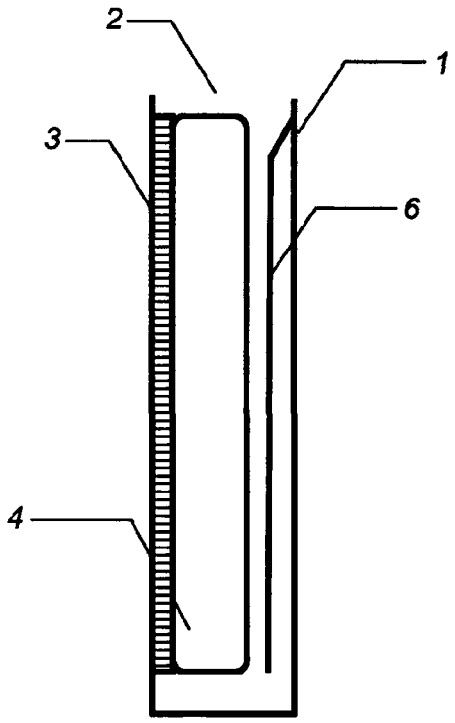
FIGS. 5*a* and 5*b* are schematic longitudinal cross-sections of a pouch in a second embodiment of the invention.
Figure 5B:
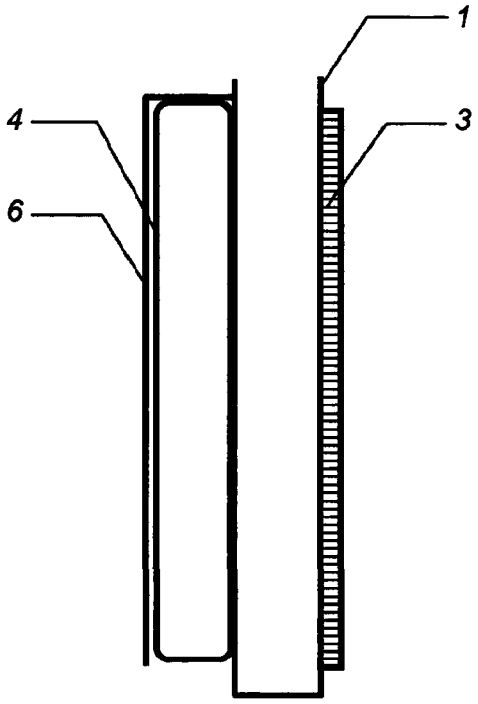

FIGS. 5*a* and 5*b* show a specific example of the second embodiment in normal and reversed configurations respectively. As shown, the cleaning material 3 may be provided on one inner face of the pouch 1. On the opposite inner face is provided a pocket 6, preferably also of cleaning material. In the normal configuration of FIG. 5*a*, the pocket 6 is open towards the bottom of the pouch 1 and is therefore inaccessible from the opening 2, which protects the interior of the pocket 6 from dirt. In the reversed configuration of FIG. 5*b*, in which the pouch 1 is turned inside out, the cleaning material 3 is disposed outwardly and may therefore be used for cleaning another device, such as a tablet computer or display screen.

To provide rigidity to the pouch 1 and therefore improve its function as a cleaning pad or mitt, it would be possible to insert the device 4 into the reversed pouch 1. However, the normally external surface of the pouch 1 may dirty or cause damage to the device 4. Instead, the device 4 may be inserted into the pocket 6, which is now accessible, as shown in FIG. 5*b*. In this way, the reversed pouch 1 may be used as a cleaning mitt or pad with the device 4 inserted for rigidity, without causing damage to the device 4.

The pocket 6 may be made of stretchable or foldable material so that, in the normal configuration of FIG. 5*a*, it occupies little space within the pouch 1, while being able to accommodate the device 4 in the reversed configuration of FIG. 5*b*.

Figure 6:
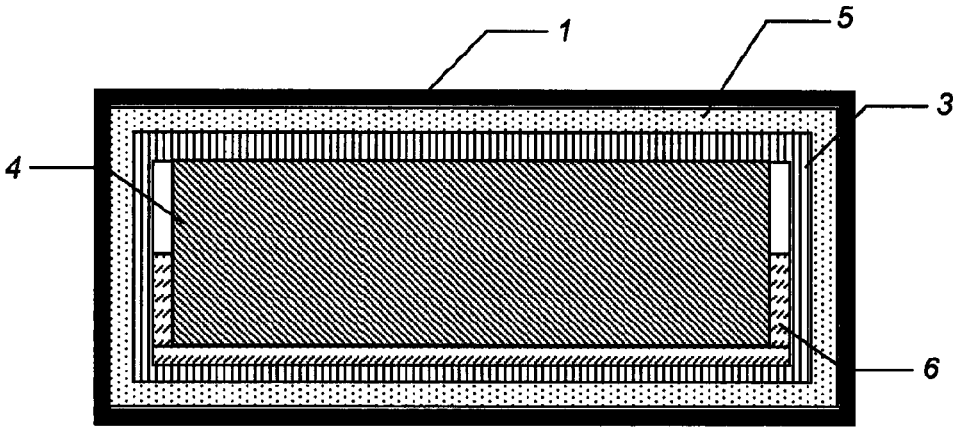
FIG. 6 is a cross-sectional view of an embodiment combining features of the first and second embodiments.

Features of the first embodiment, such as the shock-absorbing material 5, may be incorporated into the second embodiment. FIG. 6 shows a cross section of an example of one such combined embodiment in the normal configuration of FIG. 5*a*, in which the shock-absorbing layer 5 is provided within the pouch 1, the cleaning layer 3 is provided within the shock-absorbing layer 5, and the pocket 6 is shown in its closed position to one side of the device 4. In this embodiment, the shock absorbing layer 5 extends over the entire inner surface of the pouch 1, and the cleaning layer 3 extends over the entire inner surface of the shock absorbing layer 5. The pocket 6 is attached to the cleaning layer 3, and is shown in a folded position. When opened out in the reversed configuration, the pocket 6 is able to contain the device 4.

Third Embodiment

Figure 7:
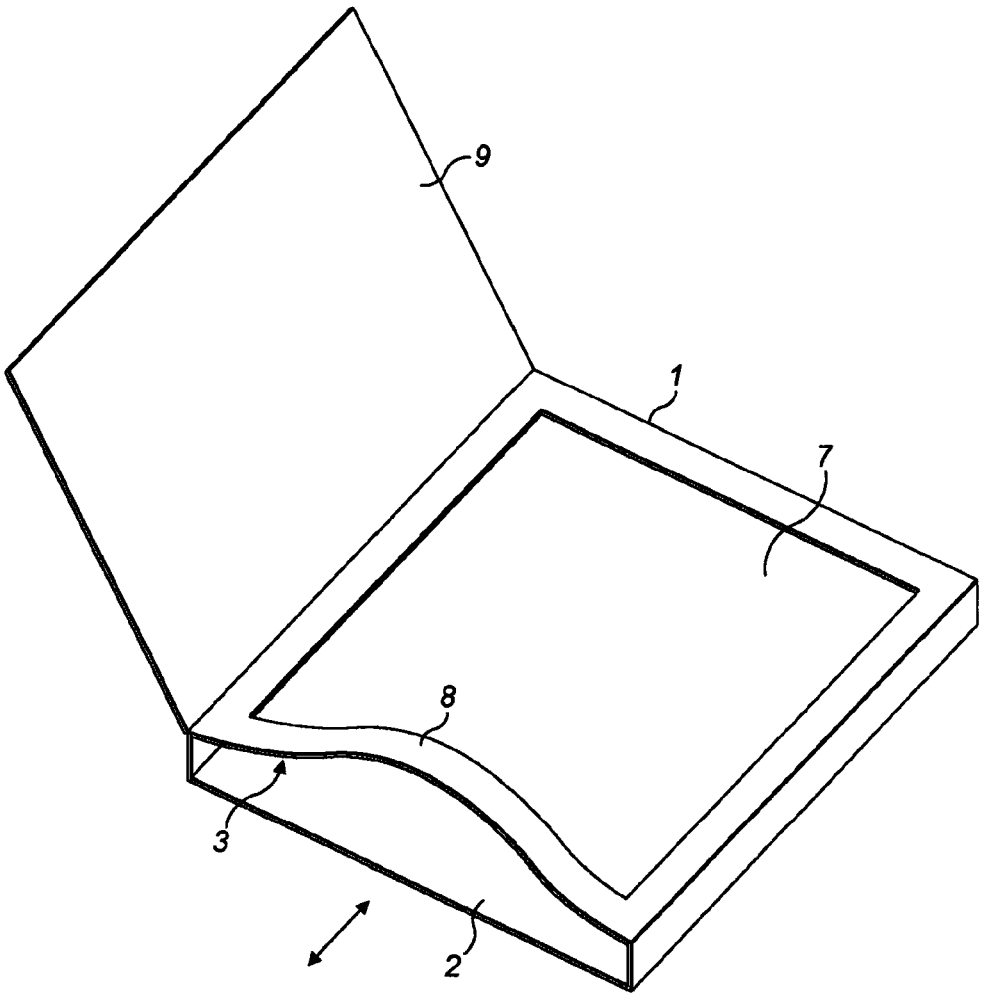
FIG. 7 is a perspective view of a case in a third embodiment of the invention.

FIG. 7 shows a third embodiment, comprising a rigid or semi-rigid protective case 1 with an opening 2 at at least one end thereof, for insertion and removal of the device 4. The case 1 has a window 7 therein through which the screen of the device 4 is visible and/or accessible when the device 4 is located within the case 1. The window 7 may be simply an opening, or may be covered with a transparent material. A surround 8 may be provided around the window 7.

In this embodiment, cleaning material 3 is provided on the inner surface of the surround 8, on the side nearest the opening 2, so that the screen of the device 4 is cleaned as it passes that side of the surround 8. The cleaning material 3 may be provided on the same side as the window 7, so that the screen is cleaned as the device 4 is inserted with the screen facing towards the window 7. Alternatively or additionally, the cleaning material 3 may be provided on the opposite side from the window 7, so that the screen is cleaned as the device 4 is inserted with the screen facing away from the window 7.

The side of the surround 8 carrying the cleaning material 3 may be resiliently biased inwardly, for example by means of a resilient insert, to enhance the pressure of the cleaning material 3 on the device 4.

As in the first embodiment, the cleaning material 3 may be removable from the case 1, for cleaning or replacement.

Optionally, the case 1 may include a moveable cover 9 for the window 7. The cover 9 may be hingedly attached to one side of the surround 8, as shown in FIG. 7, but may alternatively be slideable, pivotable or moveable in some other way.

Alternative Embodiments

Features of the above embodiments may be combined, except where they are clearly incompatible.

The above embodiments are described by way of example, and alternative embodiments which may become apparent to the skilled person on reading the above description may nevertheless fall within the scope of the claims.

The invention claimed is:

1. A housing for containing a removable mobile electronic device, wherein at least a portion of an inner surface of the housing comprises a cleaning material having a substantially permanent antimicrobial surface treatment, the housing comprising two congruent sheets of resilient material fixed together at three edges and arranged such that major inner surfaces of the housing are biased together, the housing having an opening between the congruent sheets of resilient material for sliding insertion and removal of the device into and out of the housing between the congruent sheets of resilient material; wherein, when the device is slidably removed from and/or inserted into the housing through the opening, the cleaning material wipes along, and thereby cleans at least part of the surface of the device.

2. The housing of claim 1, wherein the antimicrobial surface treatment comprises a silane base bonded to the cleaning material.

3. The housing of claim 1, wherein the antimicrobial surface treatment comprises an ionic silver surface treatment.

4. The housing of claim 1, wherein the cleaning material is removable from the housing.

5. The housing of claim 4, wherein the cleaning material is provided on a strip or substrate that is removable from the housing through the opening.

6. The housing of claim 5, wherein the strip or substrate is resilient.

7. The housing of claim 5, wherein the strip or substrate is removably held in position within the housing by abutment of its sides against the sides of the housing.

8. The housing of claim 6, wherein the resilient strip or substrate is arranged to bias the cleaning material against the surface of the device.

9. The housing of claim 1, wherein shock-absorbing material is disposed on at least a portion of the inner surface of the housing, so as to protect the device from shock.

10. The housing of claim 9, wherein the shock-absorbing material is arranged between the housing and the cleaning material.

11. The housing of claim 1, the cleaning material being provided at least on a portion of the inner surface of the housing adjacent the opening.

12. The housing of claim 11, including a window through which a portion of the device is visible and/or accessible when the device is located within the housing, wherein the cleaning material is provided adjacent the opening so as to clean said portion as the device is inserted or removed.

13. The housing of claim 12, wherein cleaning material is provided on the same side of the housing as the window, and to one side of the window.

14. The housing of claim 1, wherein the cleaning material projects inwardly of the inner surface of the housing.

15. The housing of claim 1, wherein the cleaning material is biased inwardly of the housing.

16. The housing of claim 1, wherein the housing is substantially rigid or semi-rigid.

17. The housing of claim 1, wherein the housing is flexible.

18. A system comprising:

the housing of claim 1; and the mobile device.

19. The system of claim 18, wherein the mobile device has a touch-sensitive screen, and the cleaning material is arranged to clean the touch-sensitive screen as the device is slidably removed from and/or inserted into the housing.

* * * * *